US005109768A

United States Patent [19]

Lübke et al.

[11] Patent Number: 5,109,768

[45] Date of Patent: May 5, 1992

[54] DEVICE FOR MOVING THE IMPRESSION CYLINDER OF A PRINTING PRESS INTO AND OUT OF PRINTING ENGAGEMENT WITH AN IMAGE CARRIER CYLINDER

[75] Inventors: Herbert Lübke; Wolfgang Knapheide, both of Lienen; Volker Schroder, Lengerich, all of Fed. Rep. of Germany

[73] Assignee: Windmoller & Holscher, Lengerich/Westf., Fed. Rep. of Germany

[21] Appl. No.: 519,228

[22] Filed: May 7, 1990

[30] Foreign Application Priority Data

May 11, 1989 [DE] Fed. Rep. of Germany ..... 3915481

[51] Int. Cl.[5] ..... B31F 9/00

[52] U.S. Cl. ..... 101/153; 101/247; 101/218; 101/152

[58] Field of Search ..... 101/152, 153, 247, 218, 101/137, 139, 140, 143, 144, 145, 182, 184, 185

[56] References Cited

U.S. PATENT DOCUMENTS

| | | | |
|---|---|---|---|
| 2,207,785 | 7/1940 | Crafts | 101/153 |
| 2,607,292 | 8/1952 | Harless et al. | 101/153 |
| 3,131,631 | 5/1964 | Haskin | 101/152 |
| 3,987,726 | 10/1976 | Corse | 101/218 |
| 4,063,504 | 12/1977 | Ottenhues et al. | 101/153 |
| 4,119,031 | 10/1978 | Ottenhues | 101/153 |
| 4,132,166 | 1/1979 | Bugnone | 101/153 |
| 4,527,474 | 7/1985 | Lubke et al. | 101/153 |
| 4,711,172 | 12/1987 | Capdebosc | 101/152 |
| 4,864,928 | 9/1989 | Machara | 101/218 |

FOREIGN PATENT DOCUMENTS 2822531 11/1979 Fed. Rep. of Germany ..... 101/153

*Primary Examiner*—Edgar S. Burr
*Assistant Examiner*—J. R. Keating
*Attorney, Agent, or Firm*—Fleit, Jacobson, Cohn, Price, Holman & Stern

[57] ABSTRACT

A printing press having an impression cylinder with a bearing at each end an image carrier cylinder and a frame in which both cylinders are positioned. A device is provided for moving the impression cylinder between an engaged printing position cooperating with the image carrier cylinder and a disengaged position and also for producing a larger motion of the impression cylinder for the purpose of replacing the image carrier cylinder. A lead screw is provided for each bearing for lifting and lowering the bearing of the impression cylinder and a thrust piston and cylinder unit for acting on each bearing for urging the impression cylinder towards the image carrier cylinder. A nut engages each lead screw, each nut having a tubular section with a constant external diameter, and a pinion is mounted on each tubular section, and having a hub supported for pinion rotation in a fixed position relative to the frame. The pinion is rotatively locked to the tubular section for rotation and for sliding to a limited extent for maintaining the pinion in mesh with gearing for rotatively driving the pinion during the large motion. Each bearing is compensated by balance the weight of the bearing of parts connected with the bearing and of the impression cylinder.

5 Claims, 3 Drawing Sheets

DEVICE FOR MOVING THE IMPRESSION CYLINDER OF A PRINTING PRESS INTO AND OUT OF PRINTING ENGAGEMENT WITH AN IMAGE CARRIER CYLINDER

BACKGROUND OF THE INVENTION

The invention relates to a device for moving an impression cylinder of a rotary printing press into and out of printing engagement with an image carrier cylinder, for instance a plate cylinder, and for performing a large stroke for changing the image carrier cylinder, comprising lead screws for lifting and lowering the bearings of the impression cylinder and with respective thrust piston and cylinder units acting on the lead screws for pressing the impression cylinder into printing engagement with the image carrier cylinder.

A known device of this type described in the German patent 3,337,309 which has become well accepted in practice. However, its design is comparatively complex so that it leads to an increase in the price of the printing press to which it is fitted.

SHORT SUMMARY OF THE INVENTION

One object of the present invention is to provide a device of the initially described type which has a simpler structure.

A still further object of the invention is to provide such a device which may be manufactured at a more economic price.

In order to achieve these or other objects appearing herein, in a device of the type initially described each lead screw nut is of tubular construction and a pinion is arranged in a non-rotary manner on a tubular section of the lead screw nut with a constant external diameter, such pinion being able to be moved a limited extent axially while guided axially and having its hub supported for rotation in a fixed position in relation to the frame. In its simplest form, the device in accordance with the invention consists merely of a pinion driving the lead screw nut and not able to be revolved on the lead screw nut but so guided for axial motion along a limited distance between abutments that the impression cylinder bears on the image carrier cylinder during printing without additional loading owing to the lead screw nut bearing on the housing so that the required engagement thrust of the impression cylinder on the image carrier cylinder is substantially only set by the thrust piston and cylinder unit, which will normally be of the pneumatic type.

It is convenient for the piston rod of each thrust piston and cylinder unit to articulate with the end part of a respective lever fulcrumed on the frame and which between such fulcrum and articulation points bears on the lead screw nut. This design provides a simple construction ensuring loading of the impression cylinder by the two piston and cylinder units.

The lever may bear against a collar on the tubular lead screw nut with a thrust bearing between the lever and the collar. Preferably the lever is held between two thrust bearings of the lead screw nut, of which the upper one is loaded by a compression spring.

In accordance with a particularly advantageous form of the invention, each of the bearings is provided with a device for compensating the weight of the bearing, of parts connected therewith and of the impression cylinder. This compensating device has the effect that the thrust of the impression cylinder against the impression cylinder may be adjusted sensitively using only the thrust piston and cylinder unit, since the weight of the impression cylinder and of the bearings is counterbalanced. The compensating device may include springs but is preferably in the form of a compensating pneumatic piston and cylinder unit, which acts like a tension spring set to a given force level.

In accordance with a further preferred feature of the invention each of the bearings is connected with the piston rod of the compensating piston and cylinder unit by a traction member (such as a cord) running over a pulley.

In accordance with a further feature of the invention there is a switch, secured to the frame, which in the printing setting monitors a gap between the hub of the pinion or a part connected therewith and a counter-abutment on the lead screw nut. The counter-abutment may be formed by a collar on the tubular lead screw nut.

One working embodiment of the invention will now be described in detail with reference to the drawings.

LIST OF THE SEVERAL FIGURES OF THE DRAWINGS

DETAILED DESCRIPTION OF WORKING EMBODIMENT OF THE INVENTION

On each of the two side frames 1 and 2 of a gravure printing press a housing 3 and, respectively, 4 is mounted. Since the two sides of the gravure press are identical, the following account is limited to the left side of the gravure press.

Figure 3:
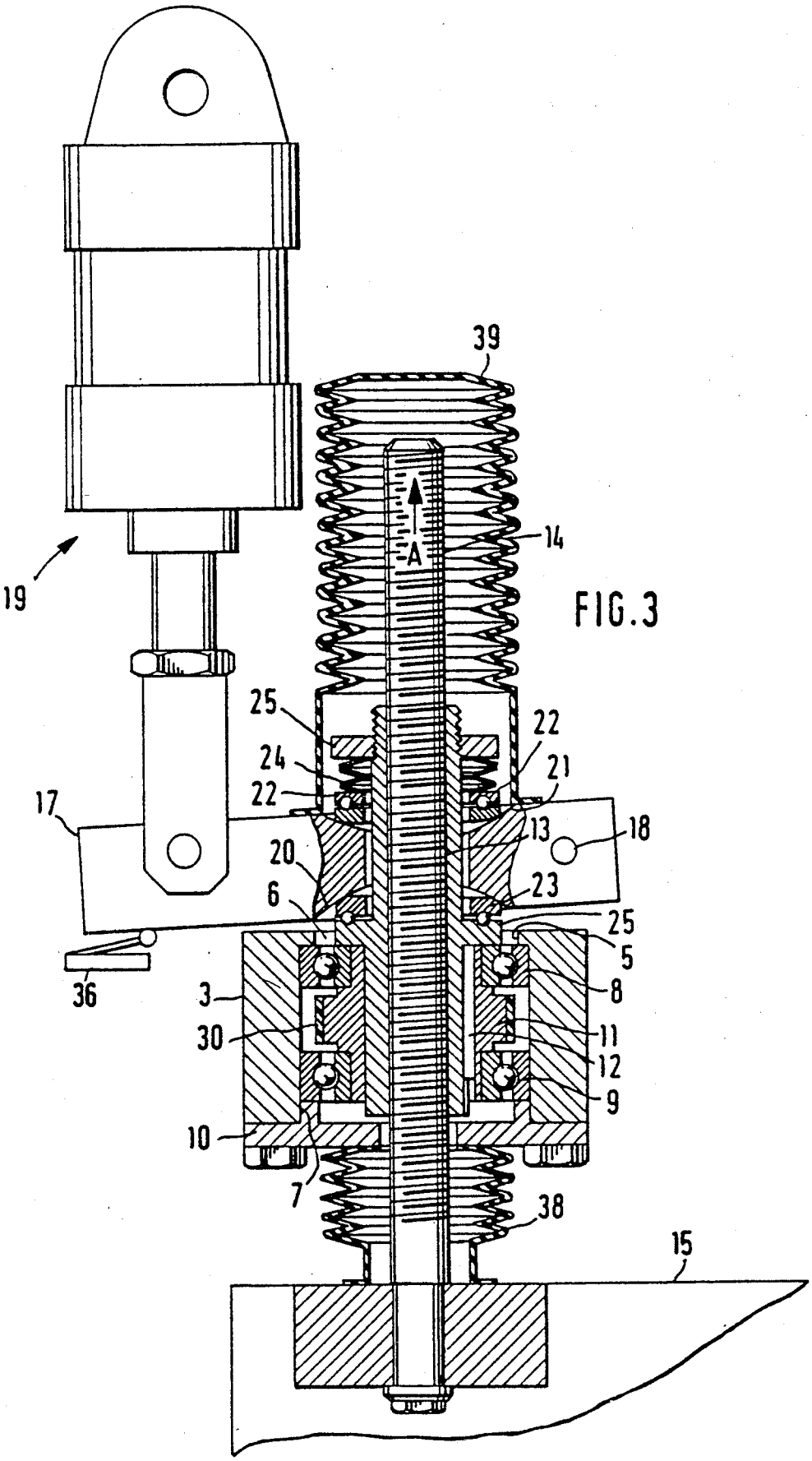
FIG. 3 is view on a larger scale of part of the structure in FIG. 2 with the impression cylinder disengaged from the image carrier cylinder.

It will more particularly be seen from FIG. 3 that the housing 3 and 4 has an upper through hole 6 provided with a collar 5 and the lower part of the housing possesses a through hole 7. The inner step formed by the collar 5 is engaged by an anti-friction bearing 8, while a further anti-friction bearing 9 is held in place by a cover plate 10, which shuts off the hole 7 at its lower end. The two bearings 8 and 9 serve to rotatably support the hub of a pinion 11, which is locked on a tube 13 by means of a key 12 so that no rotary motion relative to the tube 13 is possible, said tube 13 having a female thread and forming a lead screw nut. The channels accommodating the key 12 are made longer than the key itself so that the pinion 11 may be moved axially in relation to the tube for a short distance. The sliding displacement of the pinion 11 in relation to the tube 13 is delimited by abutments with the piston rod of the thrust piston and cylinder unit. The female thread of the tube 13 is in threaded engagement with the male thread of a lead screw 14. The latter is fixedly connected to the support plate 15 for the gravure press impression cylinder 16. Above the housing 3 the tube 13 has a lever 17 fitting around it with clearance. This lever is fulcrumed at 18, its pivoting motion being brought about by a thrust pneumatic piston and cylinder unit 19. This thrust pneumatic piston and cylinder unit 19 is connected with the side frame 1 in a manner which is not indicated. The lever 17 has oppositely placed part-spherical recesses 20 and 21, in which one respective race ring of a thrust bearing 22 and, respectively, 23 is received. The second race ring, belonging to the upper bearing 22, is so urged by a spring 24 and a nut screwed on the tube 13 that the race ring, associated with the lever 17, of the thrust bearing 23 is always in clearance-free engagement with the collar 25 of the tube 13, such collar forming the second race ring of the thrust bearing 23. It will be gathered from FIG. 1 that a motor 27 is connected with the housing 3 and has a drive pinion 29 on its output shaft 28. This pinion is connected with the pinion 11 by a driving connection in the form of a toothed belt 30.

Figure 2:
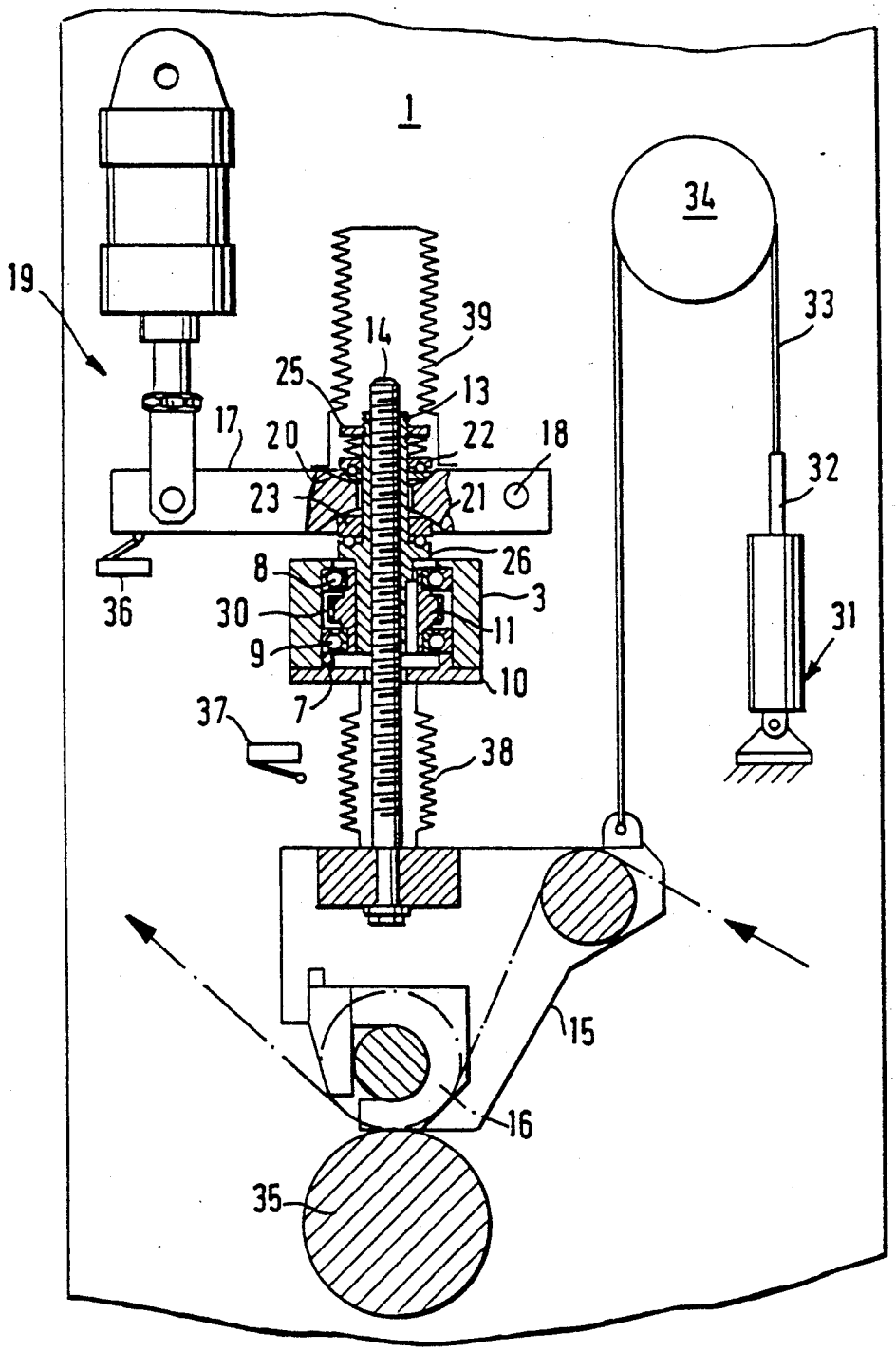
FIG. 2 is a section taken through the device on the section line II—II of FIG. 1 with the impression cylinder in printing engagement with the image carrier cylinder.

It will be seen from FIG. 2 that the weight of the support plate 15 is borne by a compensating piston and cylinder unit 31, whose piston rod 32 is connected with a traction element 33, i.e. in this case a cord, such traction element running over a bend pulley 34 and being connected with the support plate 15. The input pressure to the piston and cylinder unit 31 is adjustable so that a precisely set fraction of the weight of the support plate 15 and of the gravure impression cylinder 16 is taken up or counter-balanced.

Figure 1:
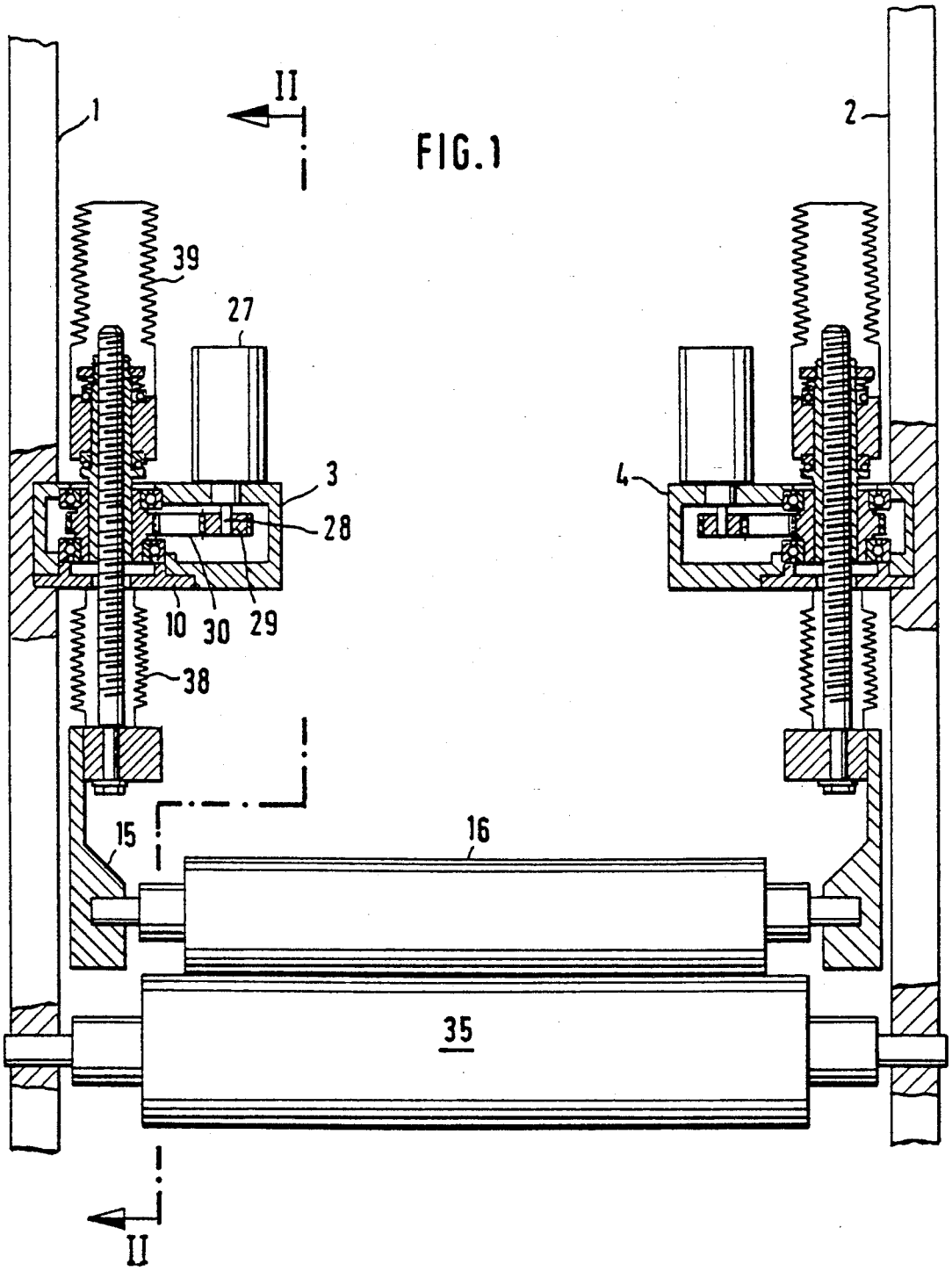
FIG. 1 is a diagrammatic front elevation of the device for moving the impression cylinder into and out of its printing position cooperating with the image carrier cylinder.

FIGS. 1 and 2 show the printing position in which the collar 26 is set at a distance from the bearing 8. If now a new image carrier or gravure plate cylinder 35 is to be mounted, the first step is to turn on the motor 27 so that via the pinion 29, the toothed belt 30, the pinion 11 and the key 12 the tube 13 is caused to rotate. The direction of rotation is so selected that the lead screw 14 is moved upwards as indicated by the arrow A, the first event then being the engagement of the collar 26 on the bearing 8 so that the impression cylinder 16 is moved clear of the image carrier cylinder 35 by the support plate 15. After a certain stroke as set by the microswitch 37, the motor 27 (FIG. 1) is turned off. As soon as another gravure image carrier cylinder and possibly another impression cylinder have been mounted, which may have a different diameter to the replaced cylinders, the motor 27 is so driven in the opposite direction that, by way of the previously described elements, the lead screw 14 is moved in a direction opposite to the direction A indicated by the arrow downwards until the impression cylinder 16 is on the new image carrier cylinder which has been mounted. On further rotation of the motor 27 the lead screw 14 will thus not be able to move further downwards. This will mean that in place of such downward motion the tube 13 will be shifted upwards and the collar 26 will be lifted clear of the bearing. When this takes place the lever 18 will be rocked clockwise about its fulcrum until the lever actuates the microswitch 36 (see FIG. 2) so that the motor 27 will then be halted. Since the thrust pneumatic piston and cylinder unit 19 is constantly kept under a precisely set input pressure, this precisely set pressure will be transmitted to the impression cylinder in manner which is independent of the diameter of the impression cylinder and the diameter of the image carrier cylinder. If now owing to some malfunction during the printing run the gap between the collar 26 and the bearing 8 should decrease, the microswitch 36 will be actuated via the lever 17 so that, for instance, an optical or acoustic alarm system is activated. The pressman then only has to switch the motor 27 on until a gap is produced between the collar 26 and the bearing 8 again.

Since the entire weight of the support plate 15 and of the gravure impression cylinder 16 is borne by the piston and cylinder unit 31, it is possible to very sensitively and precisely set the printing position independently of the weight.

The motion of the impression cylinder 16 into and out of printing engagement is caused by motors 27 under numerical control.

The lead screw 14 is protected against the ingress of foreign matter etc. by boots 38 and 39 with concertina folds.

We claim:

1. In a printing press having an impression cylinder with a bearing at each end, an image carrier cylinder and a frame in which both cylinders are positioned, a device for moving the impression cylinder between an engaged printing position cooperating with the image carrier cylinder and a disengaged position and also for producing a larger motion of the impression cylinder for the purpose of replacing the image carrier cylinder, the device comprising:

a lead screw for each bearing for lifting and lowering the bearing of the impression cylinder, a thrust piston and cylinder unit for acting on each bearing for urging the impression cylinder towards said image carrier cylinder, a nut engaging each lead screw, each nut having a tubular section with a constant external diameter, a pinion mounted on each tubular section, and having a hub supported for pinion rotation in a fixed position relative to the frame, and means to rotatively lock the pinion to the tubular section for rotation therewith and for sliding therealong to a limited extent for maintaining the pinion in mesh with gear means for rotatively driving the pinion during the large motion, the device further comprising, for each bearing, compensating means to balance the weight of the bearing, of parts connected with the bearing and of the impression cylinder.

2. The device as claimed in claim 1 wherein compensating means includes a compensating pneumatic piston and cylinder unit.

3. The device as claimed in claim 1 in which compensating means includes a pulley and a traction element trained around the pulley and connected between the bearing and the compensating unit.

4. In a printing press having an impression cylinder with a bearing at each end, an image carrier cylinder and a frame in which both cylinders are positioned, a device for moving the impression cylinder between an engaged printing position cooperating with the image carrier cylinder and a disengaged position and also for producing a larger motion of the impression cylinder for the purpose of replacing the image carrier cylinder, the device comprising:

a lead screw for each bearing for lifting and lowering the bearing of the impression cylinder, a thrust piston and cylinder unit for acting on each bearing for urging the impression cylinder towards said image carrier cylinder, a nut engaging each lead screw, each nut having a tubular section with a constant external diameter, a pinion mounted on each tubular section, and having a hub supported for pinion rotation in a fixed position relative to the frame, and means to rotatively lock the pinion to the tubular section for rotation therewith and for sliding therealong to a limited extent for maintaining the pinion in mesh with gear means for rotatively driving the pinion during the large motion, the device further comprising a switch fixed in relation to such frame and adapted to monitor a gap between the hub of such pinion or a part connected therewith and a counter-abutment of the lead screw nut.

5. The device as claimed in claim 4 wherein the counter-abutment is formed by a collar on the tubular lead screw nut.

* * * * *